US006578463B1

(12) United States Patent
Ross, Jr.

(10) Patent No.: US 6,578,463 B1
(45) Date of Patent: Jun. 17, 2003

(54) AUTOMATIC MACHINE GUN

(75) Inventor: Hubert M. Ross, Jr., Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 04/625,928

(22) Filed: Mar. 22, 1967

(51) Int. Cl.[7] ..... F41A 9/00
(52) U.S. Cl. ..... 89/33.1; 42/19; 42/1.16; 42/49.01
(58) Field of Search ..... 89/33, 33 D, 33.1, 89/33.12, 14, 125, 132, 148, 194, 199; 42/1.6, 19, 19.1, 19.2, 19.4, 50.2, 6, 17, 49

(56) References Cited

U.S. PATENT DOCUMENTS 32,316 A * 5/1861 Sibert ..... 42/39.5
821,766 A * 5/1906 Taylor
1,109,910 A * 9/1914 Eastwick
2,130,722 A * 9/1938 Kobe
2,131,412 A * 9/1938 Östman
2,634,535 A * 4/1953 Borders ..... 42/1
3,088,378 A * 5/1963 Boudreau ..... 89/161
3,237,522 A * 3/1966 Neff

* cited by examiner

*Primary Examiner*—Michael J. Carone
*Assistant Examiner*—Denise J. Buckley
(74) *Attorney, Agent, or Firm*—Laura R. Foster; David S. Kalmbaugh

(57) ABSTRACT

Miniature machine gun in which all components are housed within a cylindrical tube, the barrel being disposed axially of the tube and the magazine surrounding the barrel. Barrel and magazine is a removable unit which may be replaced by an identical unit where rapid reloading is desired; has no stock, sights or other appendages and is intended to be operated from the hip of the user.

10 Claims, 2 Drawing Sheets

AUTOMATIC MACHINE GUN

The invention described herein may be manufactured and used by or for the government of the United States of America for governmental purposes without the payment of any royalties thereon or therefor.

Certain law enforcement agencies and personnel engaged in warfare have recognized the need for a hand-held machine gun for use at relatively close range which may be rapidly brought into action and fired from the hip of the user.

This invention relates to a gun which fulfills the needs referred to which is relatively small in size and which, in appearance, has no resemblance to conventional guns.

One of the objects of the invention is to provide a gun of the type referred to which is devoid of conventional appendages, such as stock, sights, and clip or other exterior magazine, which may be more rapidly brought into action without interference from such appendages.

Another object is to provide a gun, the outer appearance of which does not resemble conventional guns.

A further object is to house all components in a minimum of space within a tubular envelope.

A further object is to provide a gun which eliminates lateral muzzle deviation and in which the only deviation is conventional recoil in a direction axially of the barrel.

A further object is to provide a barrel and magazine unit which may be readily removed from the gun housing after the magazine contents have been expended and replaced with a like loaded unit.

Still further objects, advantages and salient features will become more apparent from the description to follow, the appended claims, and the accompanying drawing, in which:

Figure 1:
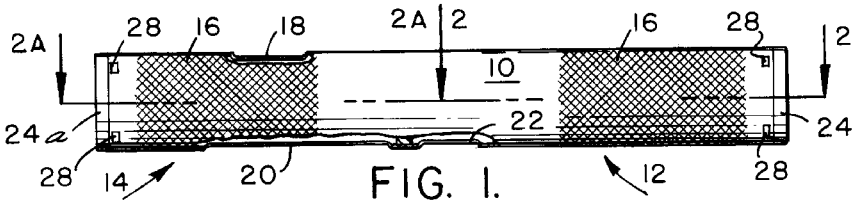
FIG. 1 is a broken away side elevation of the subject of the invention.
Figure 2:
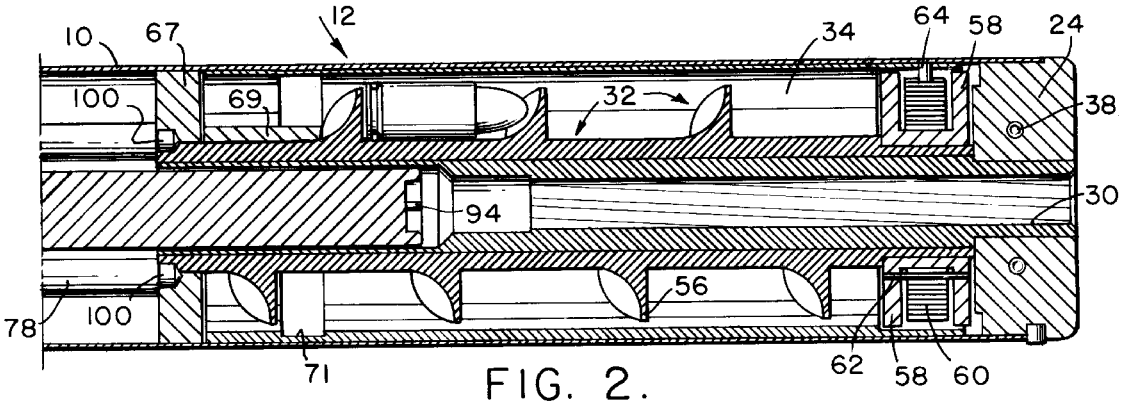
FIG. 2 is a section taken on line 2—2, FIGS. 1 and 4.
Figure 3:
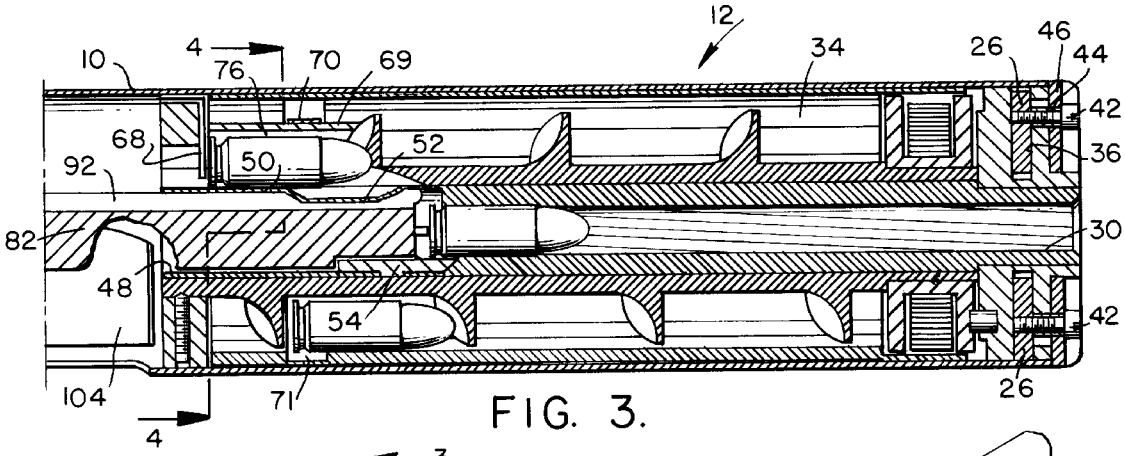
FIG. 3 is a section taken on line 3—3, FIG. 4.

Referring to the drawing, the invention comprises in general, a tubular housing 10, a removable barrel and magazine assembly 12 and a bolt and trigger assembly 14, each of which will now be described in detail.

Housing

Housing 10 is a thin-walled cylindrical tube having knurled portions 16, 16 for facilitating gripping by the hands of the user, the tube being provided with a slot 18 at its top for receiving the user's thumb for operating the trigger, a slot 20 at its bottom for receiving a finger to cock the bolt, and a slot 22 through which fired cartridges are ejected. Its front end is closed by a removable plug-like closure 24 and its rear end is closed by a similar closure 24*a,* both of which carry a pair of like latch plates 26 which engage with angularly spaced apertures 28 extending through the wall of the housing. While both of these closures form portions of the housing envelope, they are actually connected to the barrel and magazine assembly, and bolt and trigger assembly, respectively, and will thus be subsequently described in the description of such assemblies.

Barrel and Magazine Assembly

This assembly comprises, in general, front closure 24, rifled barrel 30 immovably affixed to the front closure, a spiraled cartridge container 32 immovably affixed to the barrel, and an internally fluted sleeve 34, forming a magazine driver, surrounding the spiral container and journaled within housing 10 for rotation around the stationary barrel and spiral container, the spiral container and sleeve forming principal portions of the magazine.

The front closure 24 is provided with a pair of diametrically opposed slots 36, each of which slideably receives a latch plate 26, urged outwardly by springs 38, the latch plates having fingers or detents 40 which engage in apertures 28 in the housing as previously described. Inward movement of the detents releases the front closure from the housing and permits removal of the entire barrel and magazine assembly for either replenishment, as a unit, or for manual reloading. Each latch plate is connected by a screw 42 and spacer 44 to a latch slide 46 disposed in a T-slot 47, the outer end of which may be depressed by a finger of the hand to permit release of a latch plate from the housing.

The barrel comprises a rifled portion, the rear end of which is suitably chambered to receive a loaded cartridge, and a tubular portion 48 extending rearwardly from the chamber. The tubular portion is provided with a slot 50 of a width less than the diameter of the cartridge case on which a cartridge may lie with a portion of its base projecting into the tubular portion where it may be engaged by the bolt, to subsequently be described. A widened portion 52 forms a part of this slot and is of a width to permit the cartridge to pass through it as it is being chambered by forward movement of the bolt. As the cartridge moves forward it moves angularly toward the barrel axis, and engages ramp 54. When the base moves to the rear of the widened slot it moves through it and into alignment with the chamber, further forward movement of the bolt effecting chambering of the cartridge. The front end of the barrel is suitably machined to a press fit within the front closure and suitably pinned to it.

The cartridge container 32 is provided with a central bore which receives the barrel, and an external buttress-type thread 56. A spool 58 is affixed to the forward end of this member in which a clockspring 60 is disposed, its inner end being secured to the walls of the spool by a pin 62 and its outer end secured to magazine driver 34 by a pin 64. A follower 65, which approximates the shape of a pair of adjacent cartridges, is disposed within the screw.

Magazine driver 34 is tubular, its inner face being provided with angularly spaced flutes or grooves 66, the longitudinal axes of which are parallel and paralled with the barrel axis. A portion of each cartridge in the magazine lies between adjacent convolutions of the spiral container and a portion lies within a groove in the driver. Since follower 65 approximates the shape of two adjacent cartridges, fixed together, it likewise engages the spiral member and a pair of adjacent grooves in the magazine driver.

In the operation of the magazine components just described, it will now be apparent that the clockspring provides torque to the magazine driver, the grooves of which are keyed to the cartridges. Since the cartridges must thus rotate with the magazine driver, they are constrained to slide along parallel axes in the flutes. The cartridges thus feed rearwardly in a helical path around the barrel axis to a position for transfer from the magazine into the barrel, the apparatus for which will now be described.

A centrally apertured circular plate 67 is affixed to the rear end of the spiral member and is provide with a cartridge stop 68 which limits rearward movement of the cartridges. A feed block 69 is affixed to the front face of the plate and carries a pickup leaf spring 70. To allow outward movement of the spring, the flutes are cut away to form an annular groove 71 at a position slightly forward from the rear ends of the flutes. The annular wall of the spiral container is slotted adjacent its rear end to conform to the slot in the barrel extension.

Figure 4:
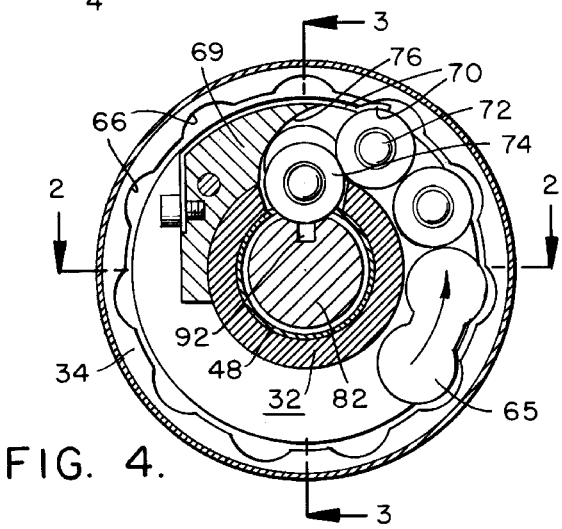
FIG. 4 is a section taken on line 4—4, FIG. 3.
Figure 5:
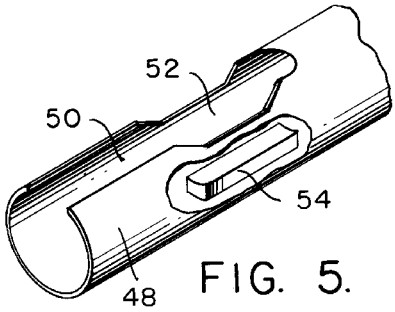
FIG. 5 is an isometric of a portion of FIG. 4.
Figure 2A:
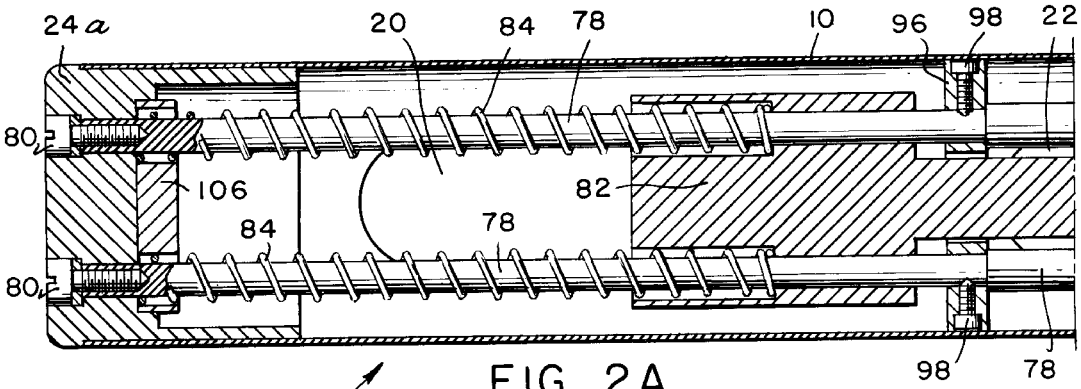
FIG. 2A is a section taken on line 2A—2A, FIG. 1, and a rearward continuation of the section of FIG. 2.
Figure 3A:
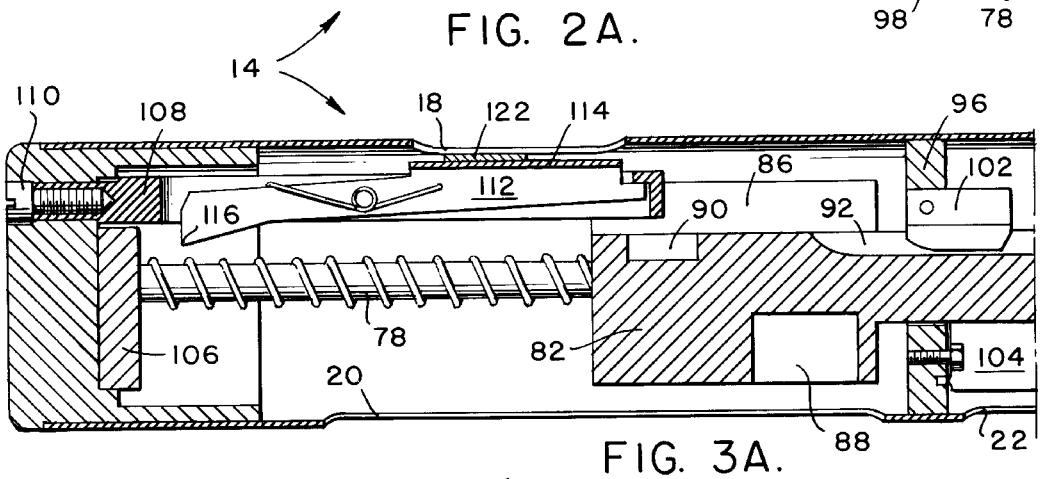
FIG. 3A is a like rearward continuation of the section of FIG. 3.
Figure 6:
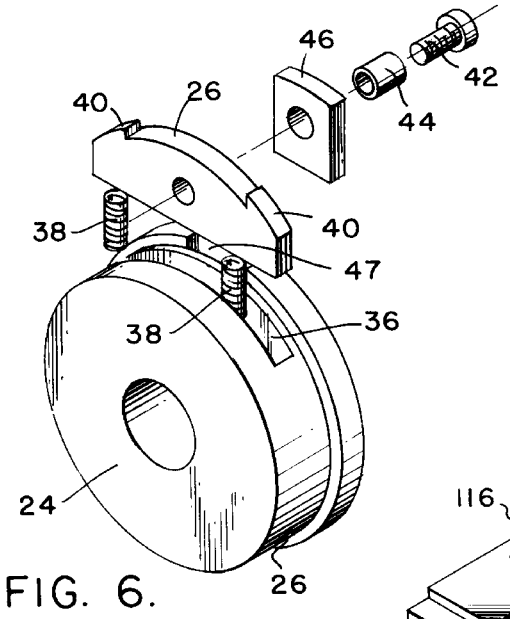
FIG. 6 is an exploded view of an end closure.
Figure 7:
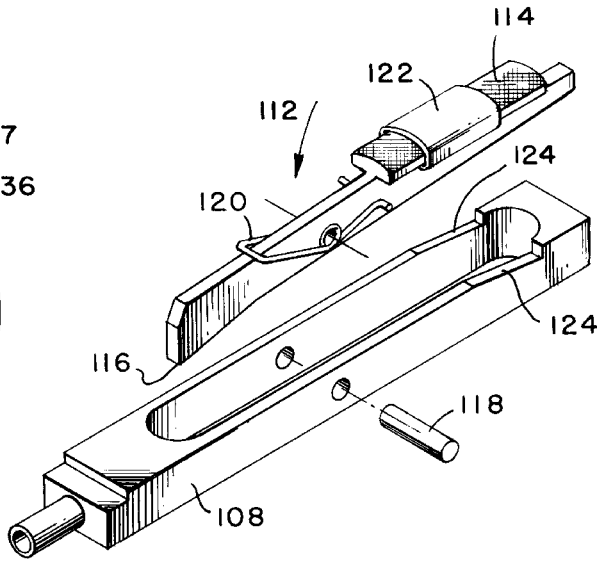
FIG. 7 is an exploded view of a trigger assembly.

In the transfer operation, and referring to FIG. 4, a cartridge 72 has been moved rearwardly into a position where it is engaged by the pickup spring. Cartridge 74, just ahead of it, has also been moved down ramp 76 on the feed block and now lies in the barrel slot ready to be chambered and fired. This arrangement of the cartridges now blocks rotation of the magazine driver by its spring. When the bolt comes forward it engages cartridge 74, moving it forward and through the barrel slot, to be chambered, as previously described. The magazine driver is now free to rotate which moves cartridge 72 down ramp 76 into the position formerly occupied by now fired cartridge 74. As will be apparent this feeding action continues as long as the bolt is permitted to reciprocate automatically. When all cartridges have been expended from the magazine the follower 65 now occupies (not shown) the position of cartridges 72 and 74. This, likewise, blocks rotation of the magazine driver and prevents further unwinding of the clockspring.

Bolt and Trigger Assembly

This assembly comprises rear closure 24*a* which may be latched to the housing by the same type of latching device employed on the front closure. The rear ends of a pair of bolt slide rods 78 are affixed to the rear closure by screws 80, the rods slideably supporting bolt 82 which is urged forward to battery position by a pair of springs 84, 84 surrounding the rods. The rear portion of the bolt is provided with a slot 86 to enable it to slide past the trigger assembly, to subsequently be described a finger hole 88 for cocking it; a pit or abutment 90; a slot 92 in which the ejector is disposed; and an integral firing pin 94. A centrally apertured circular plate 96 is provided with spaced apertures through which the slide rods extend which are secured to the plate by set screws 98. The forward ends 100 of the slide rods register with suitable semi-circular apertures in plate 67 and in the rear end of the spiral container. Plate 96 supports an ejector 102 which extends into groove 92 and an ejector duct 104 through which fired cartridges are ejected. The rear closure also has a buffer plate 106 of soft material secured to it against which the bolt may impinge at the limit of its rearward travel to absorb shock.

In the operation of the bolt it will be assumed that the bolt is at the rear of its travel and has just been released by the trigger sear. It moves forward under urge of the bolt springs and its forward end engages the base of the cartridge disposed in the feed slot, transferring it through the slot, against the feed ramp and into the chamber where it is head spaced against the forward edge of the cartridge case, the springs and inertia of the bolt producing further motion and forcing the integral firing pin into the cartridge primer. Gas pressure now expands the cartridge case in the chamber until the bullet leaves the muzzle, whereupon residual pressure in the barrel and recoil action force the cartridge and bolt rearwardly, the cartridge being stripped from the bolt head when the cartridge engages the ejector, which forces it through the ejection chute and slot. While any type of conventional extractor (not shown) may optionally be carried by the bolt, the gun action has been found to be satisfactory without an extractor.

An important feature of the bolt assembly resides in springs 84 which are formed of stainless steel consisting of multiple strands which are placed under torsion while the spring material is wound on a mandrel. Such springs, due to their elasticity factor permit shorter bolt travel and reduction in overall length of the gun. Springs of solid wire placed in the same dimension s of parts, either fractured or disto r ted in one bolt cycle.

The trigger components are supported by a rectangular trigger housing 108 the rear end of which is affixed to the rear closure by a screw 110. As will be apparent, removal of the rear closure from the housing permits removal of both the bolt assembly and trigger assembly as a unit. The trigger 112 is a bar-like member having a finger engaging portion 114 at its forward end and a sear 116 at its rear end, this member being disposed in a slot in the housing and pivoted to it by a pin 118 which also supports a spring 120 which urges the sear in a direction to engage the sear pit or abutment on the bolt. As will be apparent, by pressing downward on the finger engaging portion the sear releases the bolt for continuous automatic reciprocation as long as it remains depressed.

A slide safety 122 is carried by the trigger bar which blocks rotation of it until the safety is moved forward to a position where it may enter milled cut-aways 124 in the trigger housing. Any suitable spring urged detent (not shown) may be employed for preventing inadvertent sliding movement of the safety.

The invention, as illustrated, is approximately to scale, the overall length of the gun being about 14¾" and the diameter 2". The magazine capacity is 30 rounds of 9 mm Luger pistol ammunition and the firing rate is about 1800 per minute.

Obviously many modifications and variations of the present invention are possible in the light of the above etchings. It is therefore to be understood that within the scope of the appended claims the invention may be practiced otherwise than as specifically described.

What is claimed is:

1. A gun comprising:

(a) a circular cylindrical housing, (b) a barrel disposed axially of the housing within its forward end, (c) a cartridge magazine formed by an annular space between the barrel and housing for receiving cartridges disposed in a spiral configuration around the barrel, (d) means for bodily feeding the cartridges in a direction toward the rear of the barrel, (e) means for feeding the rearmost cartridge inwardly toward the axis of the barrel to a position in which a portion of its base is in the path of a reciprocating bolt, (f) a spring urged reciprocating bolt disposed within the rear portion of the housing slideably mounted for movement along the axis of the barrel adapted to engage said rearmost cartridge and transfer it to the barrel chamber, including a firing pin for engaging a primer carried by a cartridge, (g) a trigger device disposed within the rear portion of the housing including a sear for selectively engaging the bolt and retaining it at its rearmost position of travel.

2. A gun in accordance with claim 1 wherein said bolt is provided with an integral firing pin at its forward end.

3. A gun in accordance with claim 1 wherein said means for feeding the cartridges comprises a stationary helical member surrounding the barrel and a rotatable sleeve member surrounding the helical member having a plurality of longitudinally extending parallel flutes on its inside surface, said helical sleeve member and flutes being proportioned so that a portion of each cartridge lies within both members.

4. A gun in accordance with claim 3, including a spring for rotating the sleeve member.

5. A gun in accordance with claim 4, including a follower disposed behind the cartridges in the magazine, said follower simulating the shape of two adjacent cartridges fixed together, said follower adapted to prevent rotation of the sleeve by its spring when all cartridges in the magazine have been expended.

6. A gun in accordance with claim 1 wherein said means for feeding the rearmost cartridge comprises a feed block having a camming surface thereon.

7. A gun in accordance with claim 6 wherein said feed block carries a clip-type spring engagable with the cartridge adjacent the rearmost cartridge for urging it inwardly toward said camming surface.

8. A gun in accordance with claim 1 wherein the bolt spring is urged by at least one compression type helical coil spring formed of a plurality of strands which are torqued while being wound into a helix.

9. A gun in accordance with claim 1 wherein said barrel, cartridge magazine, means for bodily feeding the cartridges, and means for feeding the rearmost cartridges are formed as an integral assembly affixed to a front closure for the housing, and means for releasing the front closure from the housing, whereby said assembly may be removed from the housing as a unit.

10. A gun in accordance with claim 1 wherein said bolt and trigger device are assembled as a unit for bodily removal of the unit from one end of the housing.

* * * * *